United States Patent [19]

Block

[11] 4,199,067

[45] Apr. 22, 1980

[54] KEY RACK

[75] Inventor: Mitchell L. Block, Highland Park, Ill.

[73] Assignee: Block and Company, Inc., Wheeling, Ill.

[21] Appl. No.: 925,452

[22] Filed: Jul. 17, 1978

[51] Int. Cl.[2] ..... A47F 7/00

[52] U.S. Cl. ..... 211/13; 40/2 A; 40/19.5

[58] Field of Search ..... 211/13, 51, 60 R; 312/234.2, 234.5; 40/2 A, 330, 19.5

[56] References Cited

U.S. PATENT DOCUMENTS

| | | | |
|---|---|---|---|
| 956,175 | 4/1910 | Rieckoff | 40/19.5 X |
| 1,632,504 | 6/1927 | Preston | 211/51 |
| 1,742,542 | 1/1930 | Howell | 211/13 |
| 1,770,327 | 7/1930 | Thayer | 211/13 |
| 2,157,788 | 5/1939 | Howell | 40/19.5 |
| 2,159,322 | 5/1939 | Drummond | 211/13 |
| 2,851,168 | 9/1958 | Mason et al. | 211/60 R |
| 3,070,235 | 12/1962 | Manzardo | 211/13 |
| 3,497,074 | 2/1970 | Shaheen | 211/13 |
| 4,108,312 | 8/1978 | Craven | 211/13 |

*Primary Examiner*—Ramon S. Britts

*Assistant Examiner*—Robert W. Gibson, Jr.

*Attorney, Agent, or Firm*—Norman Lettvin

[57] ABSTRACT

A durable and inexpensive, integrally molded key rack for accessibly storing and conveniently organizing keys is adapted for location in and attachment to the following block of desk or filing cabinet drawers. Projecting rearwardly of the rear face of the key rack are a pair of upright clips for securing the rack to the following block and projecting forwardly of the front face are a pair of spaced, slotted, horizontally-extending, key-receiving projections for holding keys. The rack is formed with a first set of ribs extending about the periphery of the rear face and a second set of ribs extending between the clips and the key-receiving projections. The first and second sets of ribs and the key-receiving projections combine to rigidify the key rack. By molding consecutive numerical indicia in the key rack adjacent each slot and attaching a correspondingly numbered chart to the front face of the rack, the molded number adjacent each key may be matched with its associated lock or machine, thereby providing a convenient correlation guide.

4 Claims, 5 Drawing Figures

FIG. 1
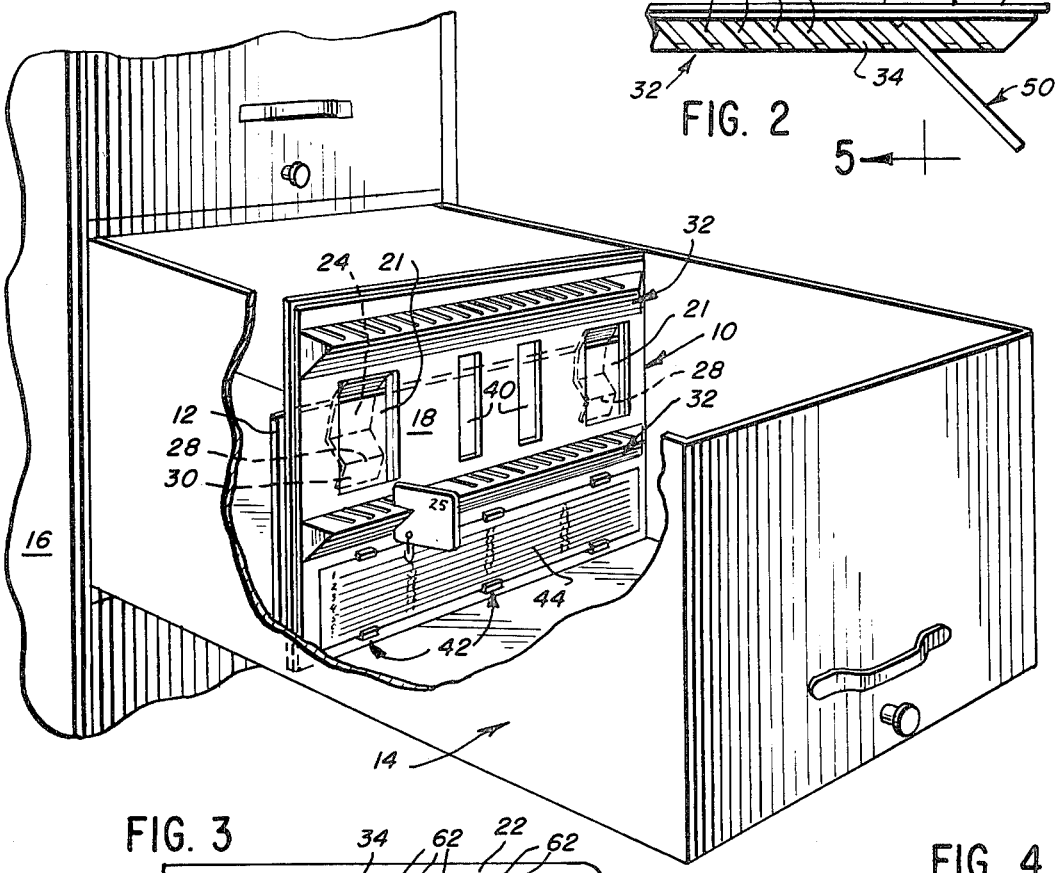
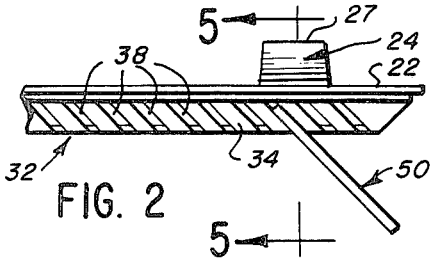
FIG. 2
FIG. 3
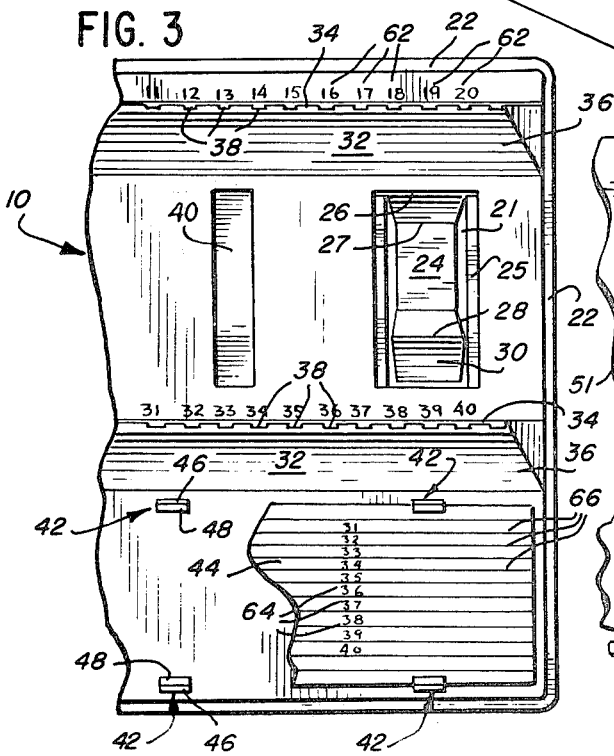
FIG. 5
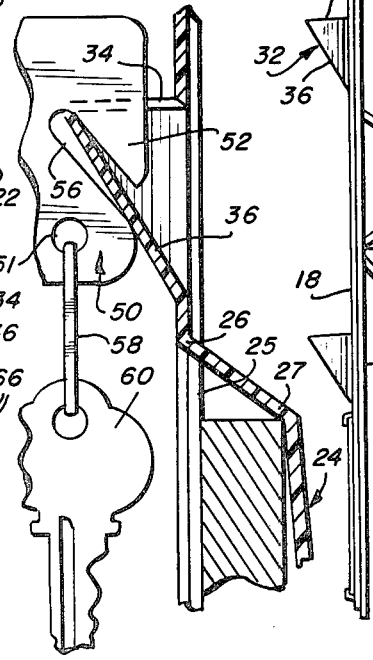
FIG. 4
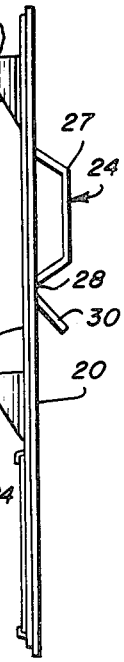

KEY RACK

FIELD OF THE INVENTION

This invention relates generally to apparatus for safely and orderly storing keys, and more particularly, to a key rack for attachment to the following block of desk and file cabinet drawers for organizing business office keys.

BACKGROUND OF THE INVENTION

In the daily operation of any business, keys are in constant use to operate various office fixtures, ranging from door locks to business machines. The number of keys and their function will depend on the type and size of the business. It is desirable to provide a common storage point for original or duplicate keys that may be under the security and control of a key office manager.

It is one object of the present invention to provide a durable and yet inexpensive key rack which can be attached to the following block that is provided as standard construction in a desk or filing cabinet drawer that can be locked for security purposes, the key rack being adapted to arrange a plurality of office related keys in an orderly and accessible array.

It is a further object of the present invention to provide a key rack which is adapted to so arrange a plurality of office keys that any given key can be quickly correlated with its associated office fixture.

These and other objects and advantages of the invention will become clear from the following detailed description of a preferred embodiment.

BRIEF SUMMARY OF THE INVENTION

A key rack is adapted for location in and attachment to the following block of desk and filing cabinet drawers so as to provide accessible storage and convenient organization of keys placed therein. The key rack includes a molded plastic body having front and rear faces. Integrally formed on the front face of the body are a pair of spaced, horizontally-extending, key-receiving projections having upper, slotted, horizontal surfaces and inclined side surfaces. Integrally formed on the rear face of the body are elongated clip means for attaching the key rack to the following block, first rib means extending about the periphery of the back face for rigidification of the body, and second rib means extending between the key-receiving projections for rigidification of the portion of the body between the projections.

The clip means comprise a pair of spaced, elongated multi-jointed fingers cantilevered from the plastic body at the uppermost edges. The lowermost joint of the fingers are outwardly bevelled so as to produce a camming effect when the neck is slid over a following block.

The slots are inclined relative to the plane of the plastic body and to the plane of the inclined side surface of the key-receiving projections. The slots cooperate with a planar, key-holding tab that has a first hook portion adapted to enter the slot and a second portion adapted to engage the inclined surface, whereby the downward force provided by a key suspended from the tab serves to firmly anchor the key-holding tab within a slot.

The key rack further includes: (1) consecutive numerical indicia molded in the body adjacent each slot for identifying the key housed in a particular slot; and (2) retention means on the front face of the body for securing a numbered chart to the key rack. By describing the function of the key opposite its number on the chart, a given key can be quickly correlated to the lock or machine with which it is associated.

BRIEF DESCRIPTION OF THE DRAWINGS

FIG. 1 is a perspective view of a filing cabinet drawer, partially broken-away to show the key rack of the present invention attached to the following block;

FIG. 2 is a fragmentary top plan view of the right-hand portion of the key rack of FIG. 1, showing a key-holding tab positioned in the slotted key-receiving projection;

FIG. 3 is a fragmentary front a elevational view of the right-hand portion of the key rack of FIG. 1 showing numerical indicia adjacent the slotted key-receiving projections and the corresponding numerical indicia printed on a key identification chart carried on the rack;

FIG. 4 is an end elevational view of the key rack of FIG. 1 showing the key-receiving projections and the clip means; and FIG. 5 is an enlarged, fragmentary cross-sectional view taken along line 5—5 of FIG. 2 showing the key-holding tab positioned in one of the slots of the key rack.

DETAILED DESCRIPTION OF THE DRAWINGS

With reference to the accompanying drawings, the key rack of the present invention is generally designated as 10.

Viewing FIG. 1, the key rack 10 is shown located in and attached to a following block 12 of a drawer 14 of a filing cabinet 16. Although not illustrated, the rack 10 is equally well suited for attachment to the following block of a desk drawer and can also be attached to any similar type of free-standing panel.

The key rack 10 is integrally molded from any inexpensive, well known, synthetic plastic resin such as polyethylene or polypropylene so as to include generally planar front and rear faces, 18 and 20. A pair of spaced, generally rectangular apertures 21 are formed through the upper portion of the key rack 10. Surrounding each aperture 21 is a rigidifying flange 25 integrally formed with the rear wall 20. A reinforcement flange 22 in the form of a first, substantially continuous rib is integrally formed with and extends substantially about the entire peripheral edge of the rack 10.

Also integrally formed with the rack 10 and projecting rearwardly of the rear face 20 are a pair of upright clips 24. The clips 24 are vertically elongated, multijointed fingers cantilevered at their uppermost edges 26 from the upper peripheral edge of the apertures 21. The clip fingers include a following block-engaging knuckle 28 adjacent their lower edges, an upper, following block-stopping joint 27 and a bevelled lowermost plate 30 angled rearwardly and downwardly form the knuckle joint 28. Because of the cantilevered attachment, pressure may be exerted on the clips to cause them to pivot rearwardly. However, due to the inherent memory characteristic of the plastic resins from which the rack 10 may be molded, the clips 24 are biased forwardly and act to return the knuckles 28 to the plane of the rear rack face 20.

A pair of elongated, generally horizontally oriented, vertically spaced, key-receiving projections 32 are integrally formed with and extend forwardly of the front face 18 of the rack 10. The key-receiving projections 32 include an uppermost, forwardly extending, generally horizontal surface 34 and an inclined surface 36 which connects the forwardmost edge of the horizontal surface 34 to the front face 18. A plurality of spaced slots such as 38 are formed in the horizontal surface 34 of the key-receiving projections 32. The slots 38 are inclined relative to the plane of the faces 18 and 20 of the key rack 10 and relative to the plane of the inclined surface 36 of the key-receiving projections 32.

Two widened, recessed ribs 40 are integrally molded with the rack 10 and extend rearwardly from the rear face 20 of the key rack 10. The recessed ribs 40 are generally vertically oriented and serve to rigidify the portion of the key rack between the spaced key-receiving projections 32 and the apertures 21.

The portion of the front face 18 of the key rack 10 below the lowermost key-receiving projection 32 includes three pairs of oppositely facing retention clips 42 shaped to hold a rectangular chart 44. Each retention clip 42 comprises a first, forwardly extending portion 46 and a second portion 48 lying in a plane parallel to but slightly spaced from the plane of the front face 18. A thin, planar sheet, such as chart 44, is slidably received between the retention clips 42 and front rack face 18. The chart 44 is imprinted with numerical indicia 64 identically corresponding to the indicia on the key-holding tab 50 and the indicia 62 adjacent the slots 38. Blank space 66 is provided adjacent each number 64 on the chart 44.

The key rack 10 is adapted to receive planar key-holding tabs 50 each constructed to include an upper hook-like portion 52 spaced above an inclined surface-engaging portion 54. The two portions 52 and 54 are separated by an angled channel 56 extending inwardly from one edge of the tab 50. Also formed in the tab 50 is an aperture 51 adapted to receive a ring 58 from which a key, such as 60, may be suspended. The upper right hand corner of the tab may be marked with indicia corresponding to numerical indicia 62 adjacent to each of the slots 38 in the key-receiving projections 32.

From the foregoing description it will be understood that the key rack 10 may be simply mounted on a following block 12 by a downward slide on motion with the ribs 22, 25, and 40 formed on the rear face of the rack 10 abutting the planar face of the following block. As the rack 10 moves downwardly, the lower plate portions 30 of the resilient clips 24 are cammed outwardly by the top edge of the following block 12. The camming action serves to pivot the clip 24 away from the following block 12 and allows the key rack to slide downwardly until the top edge of the following block engages the stopping joint 27 of the clip 24. The knuckle 28, which is the forwardmost portion of the clip 24, clamps the following block 12 between the abutment ribs 22, 25, and 40 and the clip 24.

Keys, such as 60, from the various business office fixtures are attached to the key ring 58, which is itself attached to the key-holding tab 50. The hook portion of the tab 50 is inserted into a slot 38 formed in the upper, horizontal surface 34 of the key-receiving projections 32 such that tab portion 54 engages the inclined surface 36 of the key-receiving projection 32. In this manner, the downward force provided by the key 60 suspended from the key-holding tab 50 serves to firmly anchor the tab 50 within the slot 38.

The slot 38 has a number 62 adjacent thereto which identically corresponds to the number on the upper corner of the tab 50. The chart 44 attached to the front face 18 of the key rack 10 has numbers 64 which identically correspond to the numbers on the tab 50 and adjacent the slots 38. A description of the office fixture is entered in the blank space 66 opposite the number corresponding to the number adjacent the slot 38 and on the key-holding tab 50 so that the key can be quickly located and rapidly correlated with the appropriate office fixture.

While one form of the invention has been described, it will be understood that the invention may be utilized in other forms and environments, so that the purpose of the appended claims is to cover all such forms of devices not disclosed but which embody the invention disclosed herein.

What I claim is:

1. A key rack adapted for location in and attachment to the following block of a desk or filing cabinet drawer so as to provide accessible storage and convenient monitoring of keys, the rack comprising, in combination:

an integrally molded plastic body, the body including generally planar front and rear faces;

elongated clip means integrally formed with and projecting rearwardly of the rear face of the body for attaching the key rack to a following block;

a pair of elongated, vertically spaced, key-receiving projections integrally formed with the body and extending forwardly of the front face of the body, each projection including a plurality of slots therein for maintaining the keys in spaced, orderly arrangement, each key-receiving projection including a forwardly extending, generally horizontal uppermost surface and an inclined surface connecting the forwardmost edge of the horizontal surface to the front face of the body, and said slots being formed in the horizontal surface of the key-receiving projection;

first rib means integrally formed with and extending substantially about the periphery of the rear face of the body; and second rib means integrally formed with and extending outwardly from the rear face of the body member between the key-receiving projections, the first and second rib means and the key-receiving projections providing rigidification for the plastic body.

2. A key rack as in claim 1 further including aperture means formed through the body of the key rack, the aperture means being formed immediately forward of the clip means;

the clip means comprising a vertically elongated, multi-jointed finger cantilevered at its uppermost edge from the upper peripheral edge of the aperture; and third rib means integrally formed with and extending rearwardly from the periphery of the aperture means for rigidifying the body and for providing a reinforced connection with the clip means.

3. A key rack as in claim 1 further including numerical indicia molded in the body adjacent each slot for identifying keys housed therein; and a plurality of retention means integrally formed on the front face of the body and located below the key-receiving projections for securing a chart thereto, whereby the numerical indicia of a given key can be correlated to the lock with which it is associated.

4. A key rack as in claim 1 wherein the slots are inclined relative to the plane of the body and to the plane of the inclined surface of the key-receiving projection, whereby to cooperate with a planar key-holding tab that has a first hook portion adapted to enter the slot and another portion adapted to engage said inclined surface so that the downward force provided by a key suspended from the tab serves to firmly anchor the key-holding tab within the slot.

* * * * *